US006637131B2

(12) United States Patent
Lee

(10) Patent No.: US 6,637,131 B2
(45) Date of Patent: Oct. 28, 2003

(54) WATERPROOF SHOE

(76) Inventor: Tsui-Fang Lee, No. 4, Lane 487, Jen-Ai Rd., Chu-Tung Chen, Hsin-Chu Hsien (TW)

( * ) Notice: Subject to any disclaimer, the term of this patent is extended or adjusted under 35 U.S.C. 154(b) by 32 days.

(21) Appl. No.: 10/036,061

(22) Filed: Dec. 28, 2001

(65) Prior Publication Data

US 2003/0121177 A1 Jul. 3, 2003

(51) Int. Cl.[7] ..... A43B 13/00
(52) U.S. Cl. ..... 36/17 R; 36/14
(58) Field of Search ..... 36/17 R, 14, 12

(56) References Cited

U.S. PATENT DOCUMENTS 1,852,238 A * 4/1932 Gilkerson ..... 36/17 R
1,977,568 A * 10/1934 Flint ..... 36/17 R
2,028,054 A * 1/1936 Flint ..... 36/17 R
3,028,690 A * 4/1962 Bailey ..... 36/17 R
3,070,909 A * 1/1963 Binder et al. ..... 36/14
4,182,055 A * 1/1980 Turner, Jr. ..... 36/17 R
5,732,429 A * 3/1998 Strickland ..... 36/17 R
6,226,895 B1 * 5/2001 McClelland ..... 36/17 R
2002/0040537 A1 * 4/2002 Polegato Moretti ..... 36/14

* cited by examiner

*Primary Examiner*—Ted Kavanaugh
(74) *Attorney, Agent, or Firm*—Christie, Parker & Hale, LLP

(57) ABSTRACT

A waterproof shoe includes an upper having a bottom open end which has an outer surface and an inner surface, an outer welt extending along the outer surface of the bottom open end, and an inner welt extending along the inner surface. The bottom open end is sewn to the outer and inner welts, thus forming a stitch seam. An outsole has a top side connected integrally to the bottom open end and the outer and inner welts, a bottom side, and a peripheral face connected between the top and bottom sides. The top side penetrates through the stitch seam and clearances present between the bottom open end and the outer and inner welts. The outsole is produced by forming a molding material immediately below the upper and by causing the molding material to flow into the clearances during the forming of the molding material.

1 Claim, 8 Drawing Sheets

WATERPROOF SHOE

BACKGROUND OF THE INVENTION

1. Field of the Invention

The invention relates to a waterproof shoe, more particularly to a waterproof shoe with a goodyear welt system.

2. Description of the Related Art

FIG. 1 shows a shoe 1 incorporating a conventional goodyear welt system, in which an outer welt 2 and an inner welt 3 are provided to extend along outer and inner surfaces of an upper 4 of the shoe 1, respectively. The outer and inner welts 2, 3 are sewn to a bottom open end of the upper 4 by means of a stitch seam 5. An insole 6 is disposed above the inner welt 3. An EVA filler layer 7 is disposed immediately below the insole 6. A cover sheet 8 is sewn to a bottom end of the outer welt 2. A rubber outsole 9 is adhered to a bottom end of the cover sheet 8.

The shoe 1 incorporating the above-described welt system is strong in structure. Besides, the outer welt 2 provides a tough appearance. Therefore, such a welt system is commonly used in boots, work shoes, etc. However, the shoe 1 does not have a good waterproofing effect. Referring to FIG. 2, as indicated by the arrows, water can penetrate through clearances between the outer welt 2 and the upper 4, along the stitch seam 5, and up through clearances between the upper 4 and the inner welt 3 into the interior of the shoe 1. In addition, since the filler layer 7 is formed from porous EVA material, and since the insole 6 is generally formed from cardboard paper, water that gets in through the stitch seam 5 will also penetrate into the insole 6 via the filler layer 7, thus making the shoe 1 uncomfortable to wear.

FIG. 3 shows a shoe 1' with another conventional goodyear welt system, which includes an upper 4' that has an inner side covered by a waterproof sheet 401'. The shoe 1' further includes a midsole 6' that is formed from a waterproof material and that has a pad 601' disposed thereon, which is in turn covered by a waterproof layer 602'. Although the midsole 6' can effectively prevent entry of water into the interior of the shoe 1', the construction thereof is relatively complicated and costly.

SUMMARY OF THE INVENTION

Therefore, the main object of the present invention is to provide a waterproof shoe with a goodyear welt system, which is simple to manufacture.

Accordingly, a waterproof shoe of the present invention includes:

an upper including a bottom open end which has an outer surface and an inner surface, an outer welt extending along the outer surface of the bottom open end, and an inner welt extending along the inner surface, the bottom open end being sewn to the outer and inner welts, thus forming a stitch seam;

an insole disposed inside the upper adjacent to the bottom open end and above the inner welt; and an outsole having a top side connected integrally to the bottom open end and the outer and inner welts, a bottom side, and a peripheral face connected between the top and bottom sides, the top side penetrating through the stitch seam and clearances present between the bottom open end and the outer and inner welts, the outsole being produced by forming a molding material immediately below the upper and by causing the molding material to flow into the clearances during the forming of the molding material.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
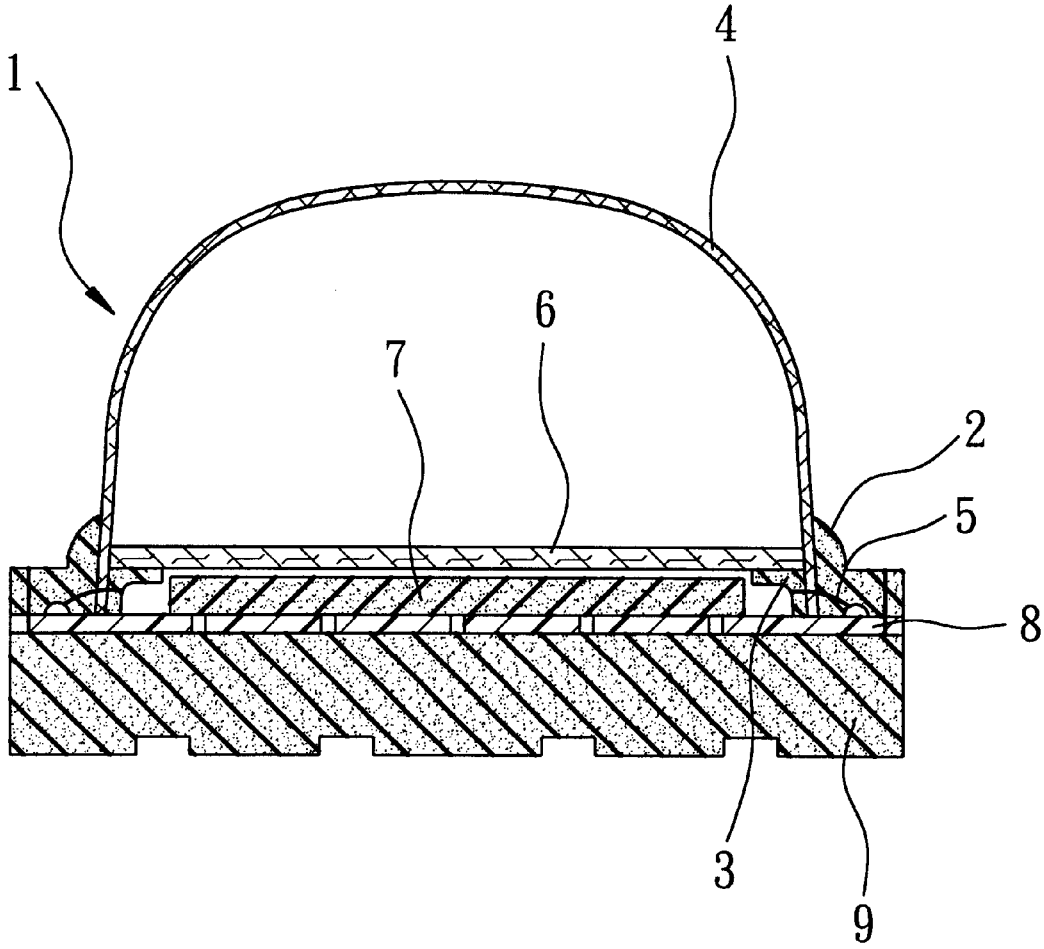
FIG. 1 PRIOR ART
FIG. 1 is a sectional view of a shoe with a conventional goodyear welt system.
Figure 2:
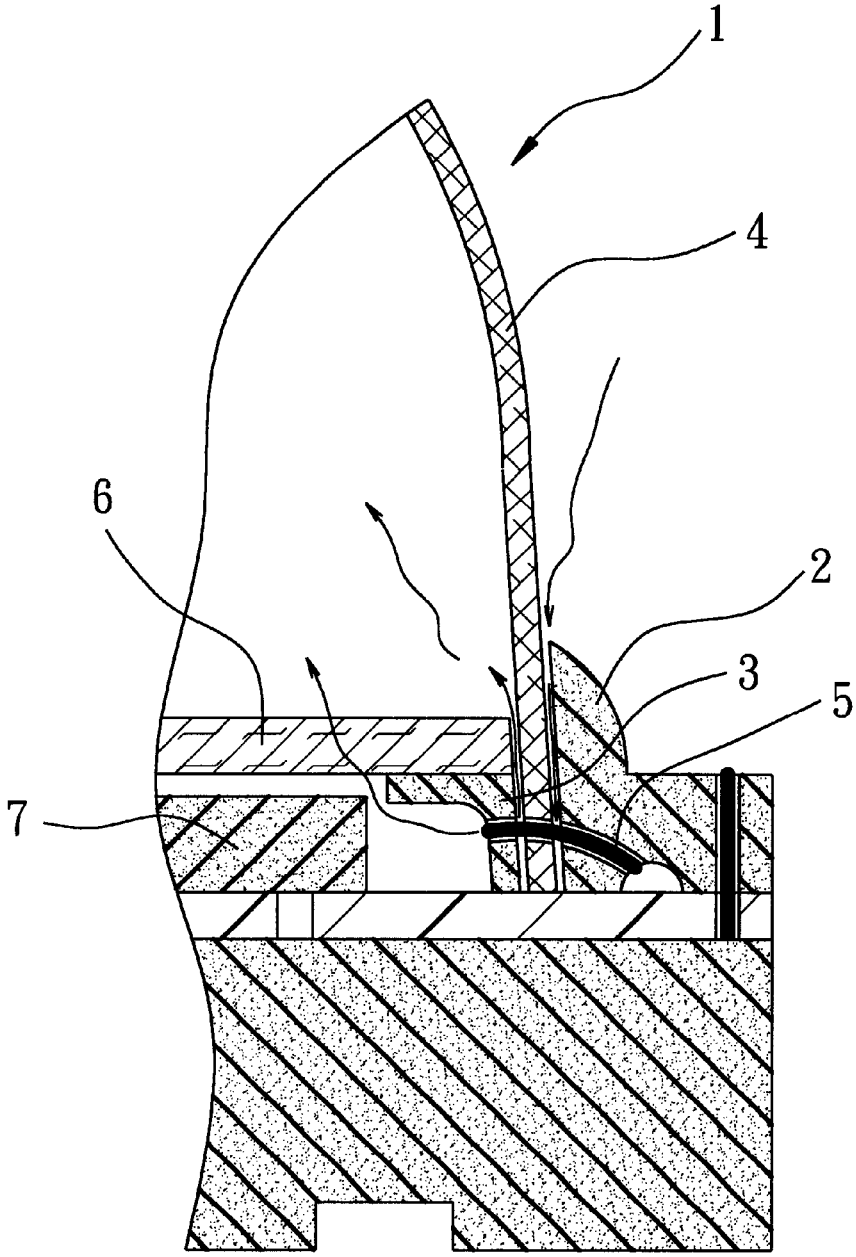
FIG. 2 PRIOR ART
FIG. 2 is a schematic partly sectional enlarged view of FIG. 1, illustrating clearances present in the conventional goodyear welt system.
Figure 3:
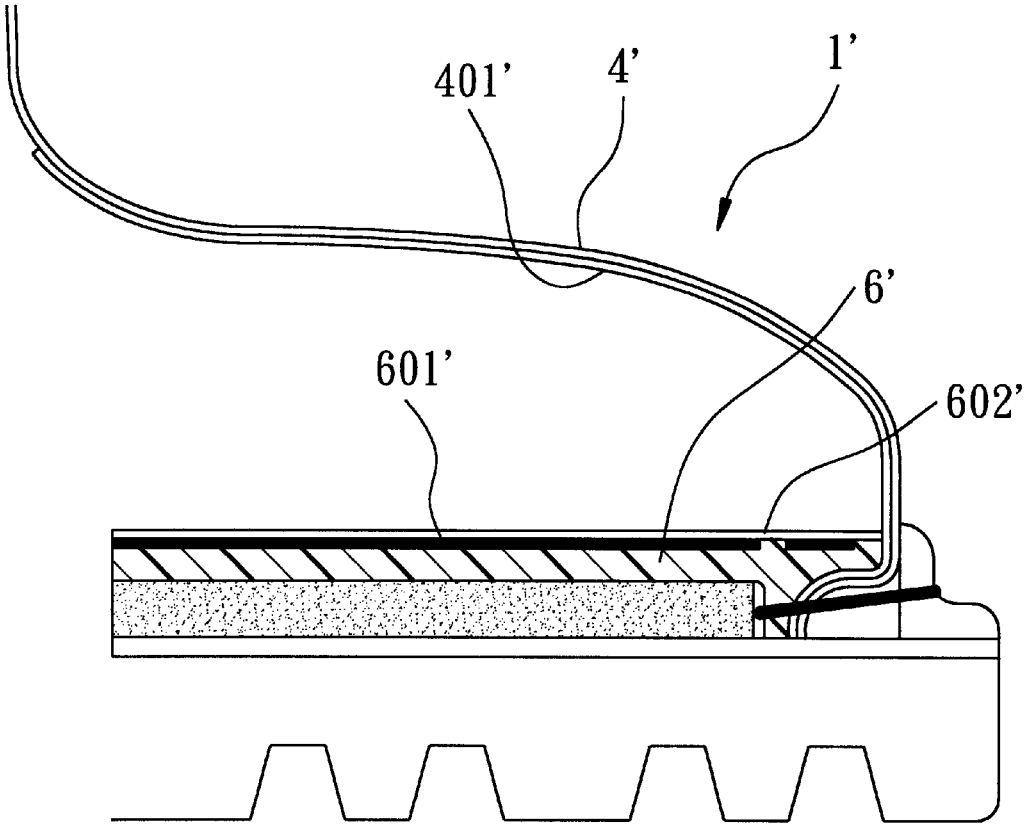
FIG. 3 PRIOR ART
FIG. 3 is a schematic sectional view of another shoe with a conventional goodyear welt system.
Figure 4:
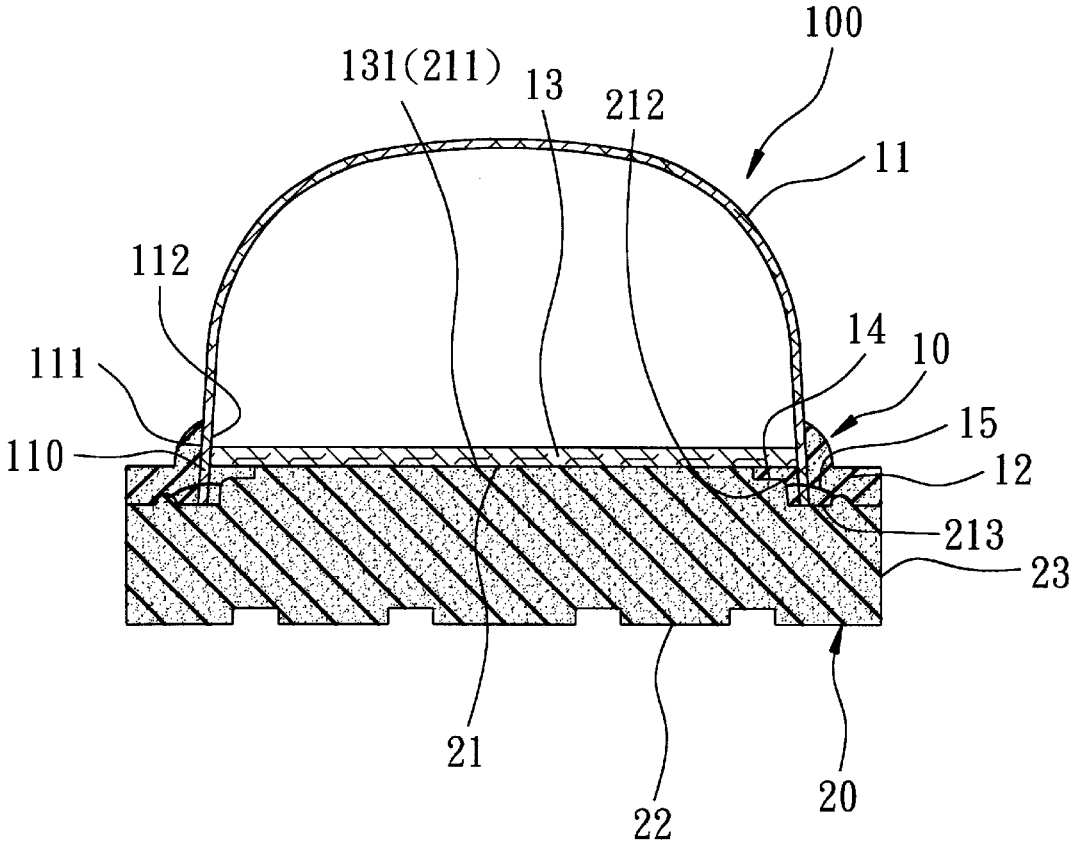
FIG. 4 is a sectional view of the first preferred embodiment of a waterproof shoe according to the present invention.

Referring to FIG. 4, the first preferred embodiment of a waterproof shoe 100 according to the present invention is shown to include a goodyear welt system 10 and an outsole 20. The goodyear welt system 10 includes an upper 11 having a bottom open end 110 which has an outer surface 111 and an inner surface 112, an outer welt 12 extending along the outer surface 111 of the bottom open end 110, and an inner welt 14 extending along the inner surface 112. An insole 13 is disposed inside the upper 11 adjacent to the bottom open end 110, and has a bottom surface 131 disposed above the inner welt 14. The insole 13 is bonded to the outsole 20, and can be formed from cardboard paper. The bottom open end 110 of the upper 11 is sewn to the outer and inner welts 12, 14, thus forming a stitch seam 15.

The outsole 20 is formed from high-density polyurethane (PU), rubber or thermoplastic urethane elastomer (TPU), and has a top side 21 connected integrally to the bottom open end 110 and the outer and inner welts 12, 14, a bottom side 22 opposite to the top side 21, and a peripheral face 23 connected between the top and bottom sides 21, 22. The top side 21 further includes a top portion 211 connected to the bottom surface 131 of the insole 13, a peripheral portion 213 connected to the bottom open end 110 and a bottom end of the outer welt 12, and a stepped portion 212 connected to a bottom end of the inner welt 14. The outsole 20 is bonded directly to the goodyear welt system 10 such that the top side 21 penetrates through the stitch seam 15 and clearances 24 (see FIG. 5) present in the insole 13, between the insole 13 and the inner welt 14, and between the bottom open end 110 and the outer and inner welts 12, 14.

Figure 5:
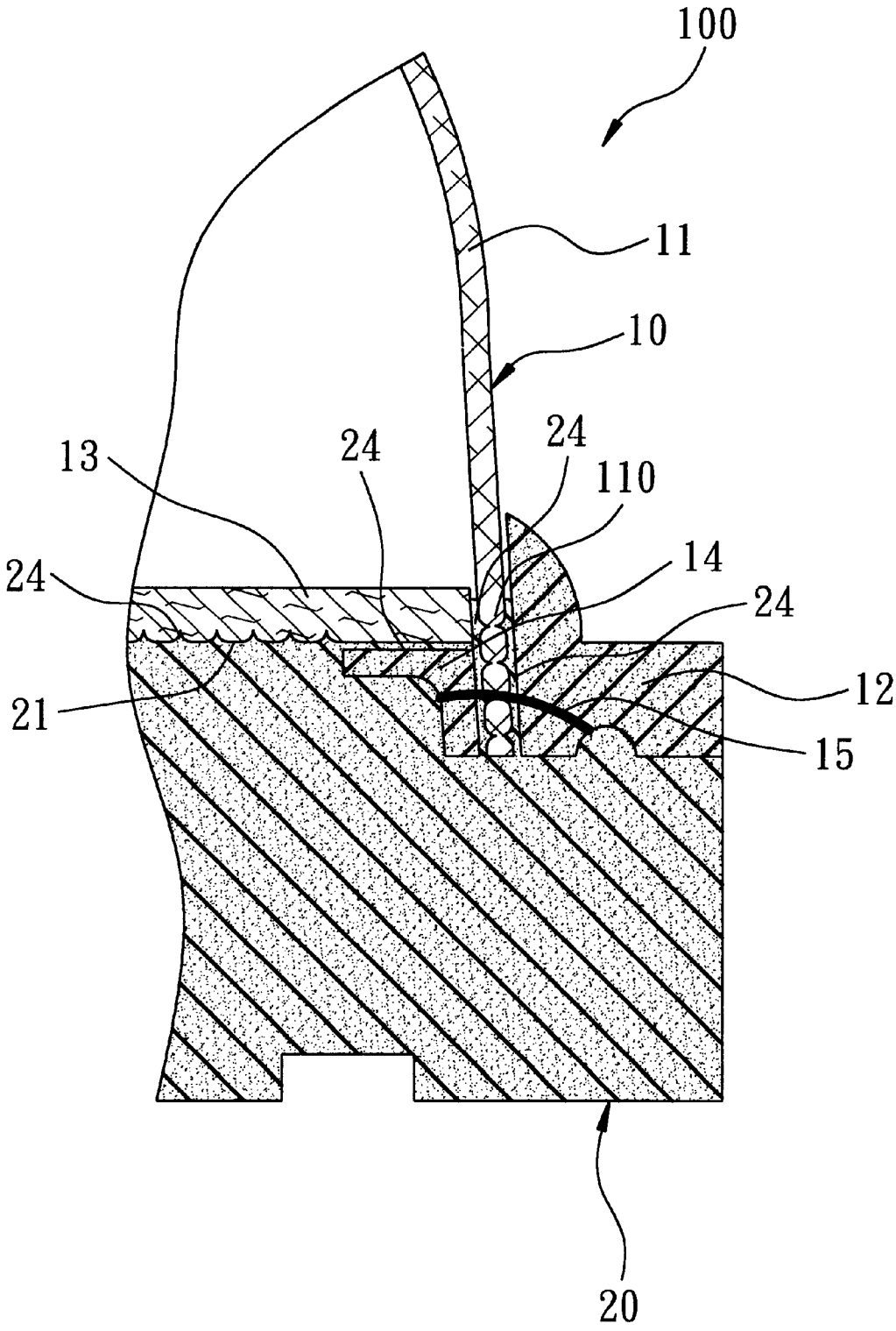
FIG. 5 is a schematic partly sectional enlarged view of the preferred embodiment.

Referring to FIG. 5, the upper 11, the outer and inner welts 12, 14, and the insole 13 are first assembled to form the goodyear welt system 10 by means of the stitch seam 15. Then, the goodyear welt system 10 is disposed in a mold (not shown) for injection molding of the outsole 20 such that the outsole 20 is formed immediately below the upper 11 and such that the molding material, which is in liquid form, penetrates into the goodyear welt system 10 to fill the clearances 24 present therein during the forming process. As such, water can be prevented from entering into the waterproof shoe 100 via the outer welt 12 and the upper 11.

Figure 6:
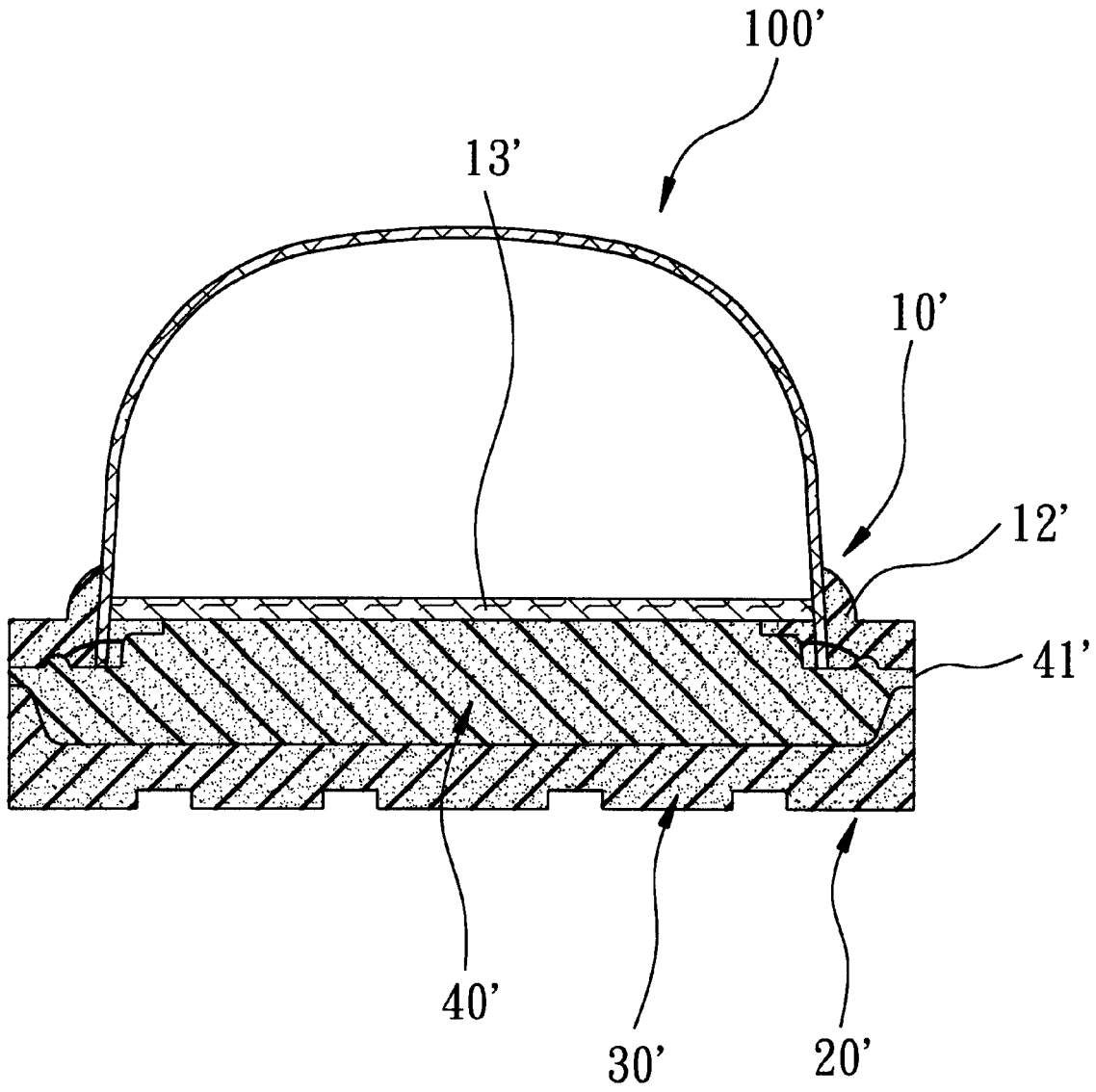
FIG. 6 is a sectional view of the second preferred embodiment of a waterproof shoe according to the present invention.

FIG. 6 illustrates the second preferred embodiment of a waterproof shoe 100' according to the invention. As shown, an outsole 20' includes a core member 40' disposed below a goodyear welt system 10', and a tread member 30' covering the core member 40'. The tread member 30' is formed from high-density PU, rubber or TPU so as to be able to withstand wear. The core member 40' is formed from low-density PU or PVC, and extends between an insole 13' and the tread member 301, with a peripheral edge portion 41' extending between an outer welt 12' and the tread member 30'. During formation of the core member 40', molding material is caused to flow into the goodyear welt system 10' to thereby provide a waterproofing effect. In addition, the core member 40' and the tread member 30' can be configured to have different colors so as to enhance the visual effect of the shoe 100' of this embodiment. The arrangement of the core member 40' can also reduce the overall weight of the shoe 100'.

Figure 7:
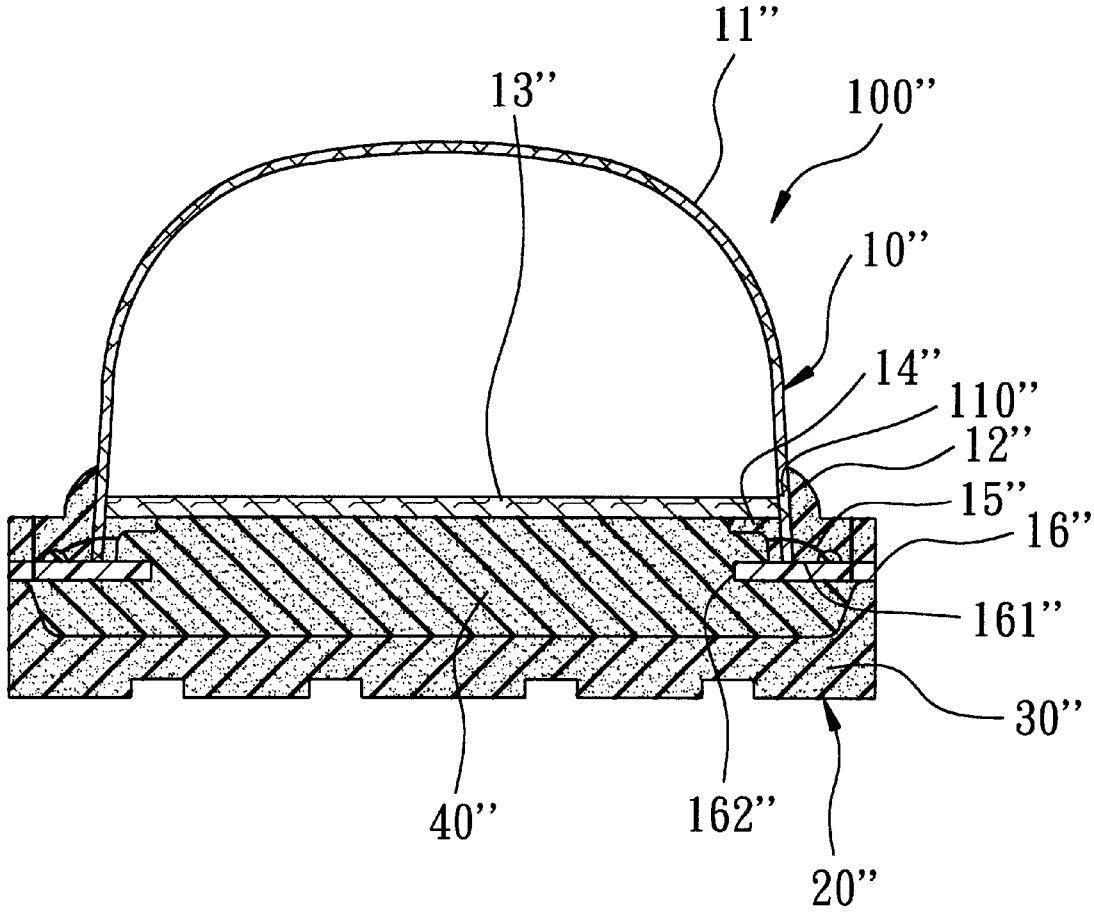
FIG. 7 is a sectional view of the third preferred embodiment of a waterproof shoe according to the present invention.

With reference to FIG. 7, the third preferred embodiment of a waterproof shoe 100" according to the invention is shown to comprise a goodyear welt system 10" which includes an upper 11", outer and inner welts 12", 14", and an insole 13". In this embodiment, the goodyear welt system 10" further includes a reinforcement ring 16" which is sewn to a bottom end of the outer welt 12" and which has an upper surface 161" extending along a bottom open end 110" of the upper 11", and the bottom ends of the outer and inner welts 12", 14". In this embodiment, the reinforcement ring 16" is formed from polyvinyl chloride (PVC) into a substantially planar plate, which is subsequently cut in the center thereof to form a through hole 162".

An outsole 20" includes a core member 40" which is directly molded below the insole 13" and the upper 11" and which penetrates through a stitch seam 15", and a tread member 30" which covers the core member 40". In this embodiment, the tread member 30" is formed from high-density PU, rubber or PTU so as to be able to withstand wear. The core member 40" is formed from low-density PU or PVC, and extends between the goodyear welt system 10" and the tread member 30" and through the through hole 162" in the reinforcement ring 16", thereby embedding the reinforcement ring 16" in the core member 40".

Figure 8:
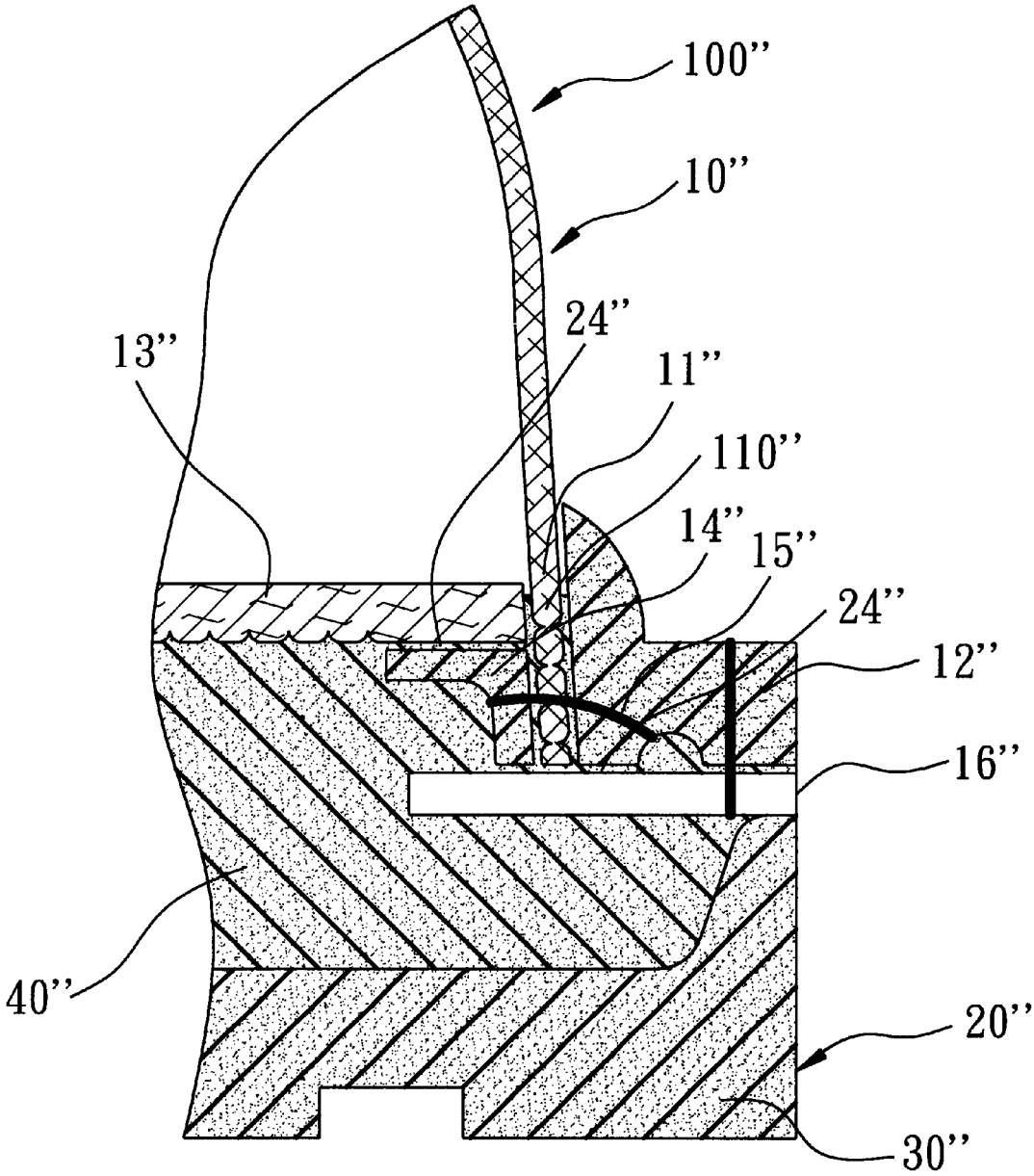
FIG. 8 is a schematic partly sectional enlarged view of the third preferred embodiment.

Referring to FIG. 8, during formation of the core member 40", liquid molding material flows into the goodyear welt system 10" to fill clearances 24" present therein. That is, the core member 40" extends into the clearances 24" in the insole 13", between the insole 13" and the inner welt 14", between the outer welt 12" and the bottom open end 110", and between the reinforcement ring 16" and the outer welt 12", and penetrates through the stitch seam 15", thereby preventing entry of water into the waterproof shoe 100" via the upper 11" and the outer welt 12". The arrangement of the core member 40" can also help reduce the weight of the waterproof shoe 100".

In view of the foregoing, it can be appreciated that the waterproof shoe according to the present invention has good waterproofing effect, is simple in construction, and is easy to manufacture and assemble.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A waterproof shoe, comprising:

an upper including a bottom open end which has an outer surface and an inner surface, an outer welt extending along said outer surface of said bottom open end, and an inner welt extending along said inner surface, said bottom open end being sewn to said outer and inner welts, thus forming a stitch seam;

an insole disposed inside said upper adjacent to said bottom open end and above said inner welt;

an outsole having a top side connected integrally to said bottom open end and said outer and inner welts, a bottom side, and a peripheral face connected between said top and bottom sides, said top side penetrating through said stitch seam and clearances present between said bottom open end and said outer and inner welts, said outsole being produced by forming a molding material immediately below said upper and by causing said molding material to flow into said clearances during the forming of the molding material, and wherein said outsole includes a core member and a tread member covering said core member, said core member being directly molded below said insole and said upper and penetrating through said stitch seam; and a reinforcement ring which extends along a bottom end of said outer welt and which is sewn to said outer welt, said reinforcement ring being embedded in said core member.

* * * * *